United States Patent [19]

Eheim

[11] 4,387,683

[45] Jun. 14, 1983

[54] FUEL INJECTION PUMP FOR INTERNAL COMBUSTION ENGINES

[75] Inventor: Franz Eheim, Stuttgart, Fed. Rep. of Germany

[73] Assignee: Robert Bosch GmbH, Stuttgart, Fed. Rep. of Germany

[21] Appl. No.: 123,608

[22] Filed: Feb. 22, 1980

[30] Foreign Application Priority Data

Mar. 10, 1979 [DE] Fed. Rep. of Germany ..... 2909558

[51] Int. Cl.[3] ..... F02D 1/06

[52] U.S. Cl. ..... 123/387; 123/502

[58] Field of Search ..... 123/502, 387, 386, 385, 123/379

[56] References Cited

U.S. PATENT DOCUMENTS

| | | | |
|---|---|---|---|
| 3,906,916 | 9/1975 | Laufer | 123/502 |
| 4,169,444 | 10/1979 | Kaibara | 123/502 |
| 4,273,090 | 6/1981 | Höfer | 123/502 |
| 4,278,058 | 7/1981 | Berner | 123/502 |

*Primary Examiner*—Charles J. Myhre
*Assistant Examiner*—Carl Stuart Miller
*Attorney, Agent, or Firm*—Edwin E. Greigg

[57] ABSTRACT

The invention relates to a fuel injection pump with a hydraulic governor and a hydraulic means of governing the onset of injection. The pressure controlled per se in proportion to the rpm is governed in accordance with load in slightly less than proportional fashion. The load-dependent control takes place by means of the adjusting piston of the hydraulic governor, which controls the cross section of a relief channel.

6 Claims, 2 Drawing Figures

FUEL INJECTION PUMP FOR INTERNAL COMBUSTION ENGINES

BACKGROUND OF THE INVENTION

The invention relates to a fuel injection pump for internal combustion engines. In a known fuel injection pump of this kind, in order to vary the onset of injection, which of itself is controlled in proportion to the rpm, during engine warm-up the adjusting pressure engaging the injection adjuster is reduced temporarily by permitting a partial fuel quantity to escape. This causes a desired adjustment of the injection onset toward "early". In order to attain this shift in injection onset control, which is provided only during engine warm-up, the valve must be controlled in accordance with temperature. This may be done by means of an expansible-substance governor or by means of a magnet.

OBJECT AND SUMMARY OF THE INVENTION

The fuel injection pump according to the invention and having the characteristics set forth herein has the advantage over the prior art in that it is possible to influence the onset of injection in a very simple manner, even during normal operation, and to do so in accordance with load. While in mechanical rpm governors, whose adjusting member is exposed to fluid and the pressure of which varies in accordance with rpm, the intention is, as much as possible, to equalize the pressure of the hydraulic forces which engage the adjusting member, the hydraulic governor being arranged to exhibit a desired pressure difference, which is utilized for the purpose of adjustment. As a result, the discharge channel can be integrated into the pump without additional expense being required for control means thereof.

The invention will be better understood and further objects and advantages thereof will become more apparent from the ensuing detailed description of preferred embodiments taken in conjunction with the drawing.

DESCRIPTION OF THE PREFERRED EMBODIMENTS

Figures 1, 2:
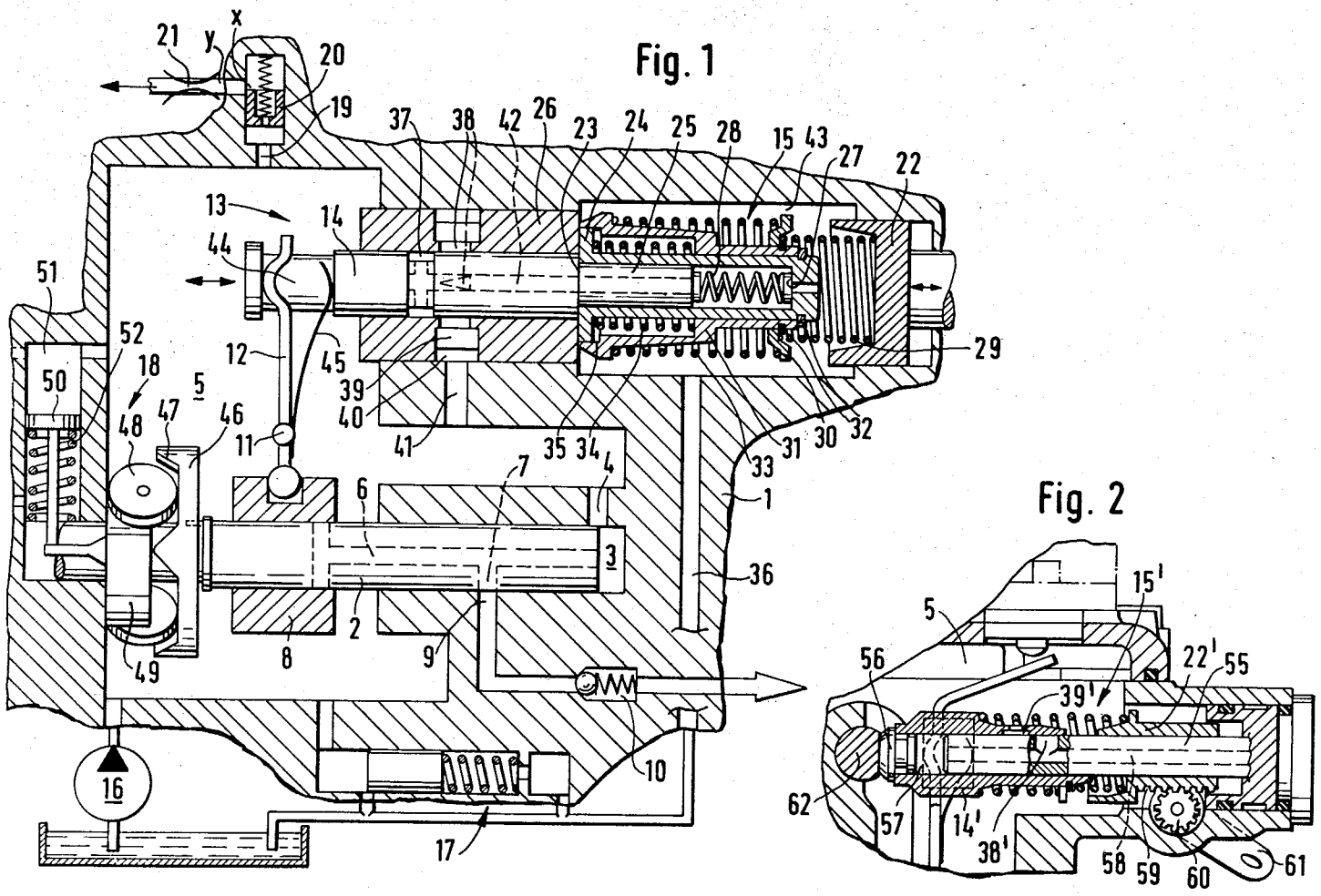
FIG. 1 is a longitudinal cross-sectional view taken through a distributor-type fuel injection pump, shown in greatly simplified form and including the first exemplary embodiment.
FIG. 2 is a detail view in cross-section of FIG. 1 pertaining to the governor and showing the second exemplary embodiment of the invention.

Turning now to the drawings, in FIG. 1, a fuel injection pump according to the invention is shown in greatly simplified form. A pump piston 2, which is set into simultaneously reciprocal and rotary motion by a known cam drive mechanism, which is not shown, operates within a housing 1. The pump piston 2 defines within the housing 1 a pump work chamber 3, which communicates via an inlet channel 4 with the pump suction chamber 5 disposed in the housing 1. A pressure channel 6 discharging into the pump work chamber 3 is disposed in the pump piston 2 and a distributor bore 7 branches off from it. This pressure channel 6 is controlled by means of an annular slide 8 which acts as the fuel quantity control member. The distributor bore 7 cooperates with pressure lines 9, which are generally uniformly distributed about the pump piston and each of which contains a check valve 10. During the suction stroke of the pump, fuel proceeds out of the suction chamber 5 and through the inlet channel 4 into the pump work chamber 3. During the subsequent compression stroke of the pump piston 2, after the inlet channel 4 is closed, fuel proceeds at high pressure, via the distributor bore 7, to one of the pressure lines 9, in order to pass therethrough and through a fuel injection valve (not shown) into a cylinder of the internal combustion engine being supplied by the pump. After an appropriate compression stroke has been performed, the pressure channel 6 in the pump piston 2 is opened by the annular slide 8 in order to terminate injection, the channel 6 being opened by means of the emergence of a mouth of the pressure channel 6 from the annular slide 8 during the compression stroke.

The fuel quantity is thus dependent on the position of the annular slide 8, which is adjustable by means of a hydraulic governor 13 via a governor lever 12 supported at 11. The hydraulic governor 13 operates with an adjusting piston 14, one end face of which is exposed to the fuel from the suction chamber 5; acting counter thereto, a spring unit 15 engages the piston, its forces being variable arbitrarily. The suction chamber 5 receives the fuel from a supply pump 16, which is driven at a rotary speed synchronous with the pump (generally, it is integrated into the pump), with the pressure in the suction chamber 5 being controlled via a pressure control valve 17 in accordance with rpm; that is, the pressure increases with increasing rpm.

An injection time adjustment apparatus 18 is also under the influence of fuel from the suction chamber 5.

Branching off from the suction chamber 5 in the housing 1 is a discharge channel 19, in which an overflow valve 20 which acts as a constant-flow valve is disposed. In order to influence the control pressure, a throttle valve 21 can be added subsequent to this overflow valve 20. The functioning of the overflow valve 20 or of the subsequent throttle valve is as follows: The overflow quantity is controlled by means of the cross section x between the slide shaft and the bore y on the basis of the hydraulic balance—that is, the ratio of pressure times the front slide surface area to the reduced pressure on the rear slide surface times the slide surface area plus the spring force.

The spring unit 15 is arranged to act counter to the hydraulic force that engages the piston 14 and may comprise one spring or a plurality of springs, which cooperate via spring plates and are made to act in sequence in an advantageous manner. In each case, the force of at least one of the springs can be varied by means of a coupler member 22, which is embodied here in the form of a piston, disposed coaxially with the actual adjusting piston in the housing 1, and which is axially adjustable from outside the pump housing 1 by means of an adjusting lever (not shown). Upon removal of the coupler member 22, the spring unit 15 can be separated from the adjusting piston 14 in a very simple manner and then exchanged for another spring unit; that is, with the same fundamental embodiment, different spring units can be used. The adjusting piston 14 has a step or shelf area 23, which serves as a contact surface for a flanged sleeve 24, said flange providing a spring support plate, said flanged sleeve arranged to be placed over the reduced-diameter or stub portion 25 of the adjusting piston 14. The flanged sleeve 24 is supported with its plate, in the illustrated example, on a bushing 26 attached to the housing 1. A starting spring 28 is disposed between the base 27 of the sleeve 24 and the end face of the stub portion 25. When the engine stops, the starting spring 28 displaces the adjusting piston 14 and thus the stub portion 25 a predetermined distance out of the sleeve 24, as a result of which the annular slide 8 of the injection pump is in turn displaced (toward the right in the drawing) to such an extent that the mouth of the pressure channel 6 no longer emerges from the annular slide 8; thus the entire fuel quantity supplied by the fuel injection pump is injected as a starting quantity. Then, as soon as the engine has started, and a predetermined pressure has been established in the suction chamber 5 via the supply pump 16, the adjusting piston 14 is displaced against the starting spring 28, until the step 23 strikes the sleeve 24; with respect to the position of the annular slide 8, this corresponds to full load.

The idling rpm is governed by means of an idling spring 29, which is supported on one end on the coupler member or piston 22 and on the other end on an intermediately disposed spring plate 30, which is supported in axially displaceable fashion in the direction of the force of the spring 29 on a spring plate bushing 31, which is likewise disposed in axially displaceable fashion in the same direction on the sleeve 24. The freedom of motion in the opposite direction is prevented in each case by a securing ring 32 disposed on the sleeve 24 or more specifically in a recess provided in said sleeve 24 and against which the spring plate bushing 31 is arranged to abut. A governor spring 33 engages the side of the intermediate spring plate 30 remote from the idling spring 29 and is supported on the other end on a shelf area provided on the spring plate bushing 31. An adjustment spring 34 is disposed between the spring plate bushing 31 and the spring plate sleeve 24, with the travel path of the sleeve 24—that is, the variation of the force of the adjustment spring 34—being limited by a flange or shoulder 35 provided on the spring plate bushing 31.

The governor functions as follows: After starting of the engine and compression of the starting spring 28, and as long as the piston or coupler member 22 is in the idling position corresponding to idling rpm, the adjusting piston 14, which includes the spring unit 15, is displaced toward the right and toward the coupler member or piston 22 by the fuel pressure in the suction chamber 5. At the same time, the annular slide 8 is displaced in a downward direction until the injection quantity effects an idling rpm which is governed by means of a remnant spring travel path of the idling spring 29 which has a degree of irregularity which is as low as possible. In FIG. 1, the adjusting piston 14 is in the position shown in the drawing after starting, but before the displacement into the idling position. In contrast, the coupler member 22 is displaced out of the idling position downwardly, in the direction of the adjusting piston 14. That is, as soon as the adjusting piston 14 with the spring packet 15 has been displaced toward the right when there is sufficient pressure in the suction chamber 5, idling is no longer attained; instead, a fuel injection quantity is effected which corresponds to partial load. Now, as soon as the load on the engine decreases, the rpm and thus the pressure in the suction chamber 5 increases, and the adjusting piston 14 displaces the sleeve 24 and the spring plate bushing 31 toward the right against the force of the governor spring 33, which then causes a downward control of the fuel injection quantity. Depending upon how the piston or coupler member 22 is displaced by the gas pedal, a different fuel injection quantity is thus established. For example, after exceeding the maximum permissible rpm, the spring 33 is compressed and a downward control of the fuel supply is effected accordingly. In FIG. 1, the spring unit 15 assumes the position for full load—that is, a position which is assumed during operation of the engine whenever it is brought about by means of the coupler member 22 when it is pushed against the spring plate 30 (full load position). This governor thus functions as an idling end governor, that is, a governor which governs solely the idling or final rpm. In the intermediate-load positions, the injection quantity is determined by the driver of the vehicle equipped with an engine equipped with this device. In the example shown in FIG. 1, the spring plate bushing 31 is supported in the full-load position in the left-hand half of the housing 1 as shown at 26, so that the adaptation spring 34 can be effective over the entire arbitrary adjustment range, and in particular at full load. That is, at full load, even when the spring plate bushing 31 is resting against the housing, the cap 24 can travel the distance of an adjustment path before downward control occurs as a result of compression of the governor spring 33.

The chamber which encloses the spring unit 15, into which the coupler member 22 protrudes on one end and the adjusting piston 14 protrudes on the other end, is relieved of pressure toward the suction side of the supply pump 16 via a channel 36. In the governor according to the invention, the principle of balance between the hydraulic pressure on one side and the spring forces on the other side is optimally attained by means of the favorable structural arrangement and the small structural space required. In accordance with the invention, the spring unit 15 can also be so embodied that the governor functions as an adjustment governor (FIG. 2); that is, that a certain rpm of the engine corresponds to every position of the coupler member 22.

An additional opportunity for introducing an adjustment variable for load dependence into the control circuit is offered in that a portion of the fuel located in the suction chamber 5 flows out under load-dependent control, as a result of which the pressure also changes in a load-dependent manner. This causes, on the one hand, a corresponding change in the pressure exerted on the adjusting piston 14, and, on the other hand, a change in the adjustment variable of the piston 18. As a result, the onset of injection is changed in accordance with load. In order to control this outflow in an intended manner, an annular groove 37 is disposed in the adjusting piston 14, which cooperates with control slits 38 in the ring 26 attached to the housing. The control slits 38 communicate with the suction chamber 5 via bores 39, an annular groove 40—each disposed in the ring 26 attached to the housing—and a bore 41. The annular groove 41 is connected by a channel 42 which extends within the adjusting piston 14 and is arranged to discharge on the spring side thereof with the chamber 43 which is relieved of pressure and encloses the spring unit 15. Depending upon the position of the adjustment piston 14, the annular groove 37 overlaps the control slits 38, which may be triangular in form, for example, to a greater or lesser extent. Because the position of the adjusting piston is load-dependent, the discharge cross section is accordingly likewise load-dependent. Accordingly, the pressure in the suction chamber 5 does not increase in proportion to the rpm, but rather, depending on the load, in somewhat less than proportional fashion as the load increases. The lower pressure thus resulting at maximum rpm can be compensated for accordingly on the part of the spring.

In order to enable a displacement by the governor lever 12 of the annular slide 8 in the direction of a shut-off of the engine independently of the position of the governor 13, the governor lever 12, on the side remote from the annular slide 8, engages a relatively wide annular groove 44 of the adjusting piston 14, with a play-compensating spring 45 being arranged to cause the governor lever 12 to be automatically coupled with the adjusting piston 14 only in the direction of downward control of the fuel supply. Accordingly, the governor lever 12 is arbitrarily adjustable only in this direction.

A cam ring 46 is connected in rotationally locking fashion with the pump piston 2 and runs with its cam track 47 on rollers 48 of a rotatable roller ring 49 supported in the housing 1. The roller ring 49 can be rotated by means of an adjusting piston 50. Depending upon the amount of rotation, the onset of the compression stroke of the pump piston 2, and thus the onset of injection, varies. The adjusting piston 50 is urged on one side by the pressure which prevails in the cylindrical chamber 51 receiving this piston 50 against the force of a restoring spring 52. The cylindrical chamber 51 communicates in unthrottled fashion with the suction chamber 5, so that the load-dependent pressure change which results from the adjusting piston 14 and the control of the discharge outflow quantities directly affects the onset of injection.

In the second exemplary embodiment shown in FIG. 2, the adjusting piston 14' is embodied as a hollow piston closed on one end and displaceably disposed on a rod 55 that is attached to the housing. A plug 56 serves to close the piston 14'. The chamber 57 enclosed by the piston 14', the plug 56 and the rod 55 is relieved of pressure via a relief bore 58. A spring packet 15' engages the piston 14', acting in principle like that of the first exemplary embodiment, its tension being variable by means of an adjusting member 22'. The adjusting member 22' has a rack 59 on its jacket surface which is engaged by a pinion 60, which is rotatable via an adjusting lever 61. This adjusting lever 61 is adjusted arbitrarily in effecting an adaptation to the load; as a result, the load acts, not only via the rpm, but also via the spring unit 15' or via the direct driving of the piston 14' by the adjusting member 22', as an engine characteristic affecting the position of the adjusting piston 14'. The load-dependent discharge of fuel from the suction chamber 5 in accordance with the invention takes place by way of an annular groove 39' which communicates with the suction chamber 5, which groove 39' cooperates with control openings 38' in the rod 55.

In the first and in the second embodiment as well, the supplementary discharge of fuel from the suction chamber 5 is only initiated when the adjusting piston 14 assumes a position for partial load. At full load, as shown in the drawing, the control cross sections are separated from one another. The same is true for the starting position. In the second exemplary embodiment shown in FIG. 2, an adjusting piston 62 shown in cross section and having a contour path acts as the stop for the piston 14', that is, for the starting position or the full-load position of the piston 14'.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection pump for internal combustion engines having a pump housing a cam drive to effect rotational and reciprocal movement for the supply movement of at least a pump piston, said pump including a portion supported in said pump housing which is adjustable relative to its rotating portion counter to a restoring force for the purpose of adjusting the onset of injection by means of a displaceable adjusting piston in a working cylinder, said working cylinder being at least indirectly connected to receive fuel from a fuel supply pump, the supply pressure of said fuel supply pump being controllable in proportion to the rpm by means of a pressure control valve and said supply pressure being further controllable by means of the supplementary discharge of a partial quantity of fuel through a discharge channel including an overflow valve, characterized in that said injection pump is controlled by means of a hydraulic rpm governor, said rpm governor including a governor piston extending into said pump housing having opposite end portions one of which is exposed to the supply pressure of said fuel supply pump and adjustable counter to the force of governor springs within said pump housing, a bushing surrounding a portion of said governor piston and fixed in a bore in said pump housing, one end of said governor piston extending into a pressure-relieved chamber which encompasses said governor springs, and further that said governor piston at least controls a relief channel in said housing, said bushing and said governor piston which indirectly effects pressure in said working cylinder of said adjusting piston, said relief channel including mouth portions in said bushing and said governor piston arranged to overlap one another to a greater or lesser extent during movement of said governor piston for controlling the cross section of said mouth portions in said bushing in said pump housing for controlling discharge of fuel from said injection pump.

2. A fuel injection pump in accordance with claim 1, characterized in that said governor piston comprises a hollow body slidably arranged on a rod having a longitudinal passage therethrough each said rod and said piston including mouth portions arranged to overlap one another to a greater or lesser extent during the movement of said governor piston for the purpose of controlling the cross section of said mouth portions and discharge of fuel therethrough.

3. A fuel injection pump in accordance with claim 1, characterized in that said relief channel extends in said adjusting piston which comprises the pressure-relieved end portion of said governor piston.

4. A fuel injection pump in accordance with claim 3, characterized in that said relief channel in said governor piston includes an annular groove, said groove being arranged to cooperate with said control mouth disposed in the bushing which receives said governor piston.

5. A fuel injection pump in accordance with claim 1, characterized in that said relief channel has a cross section which decreases with increasing rpm and at increasing load.

6. A fuel injection pump in accordance with claim 1, characterized in that said pump piston simultaneously reciprocates and rotates and that an annular slide element is articulated on said pump piston by means of the governor piston for the purpose of controlling the injection quantity.

* * * * *